US006530871B1

(12) United States Patent
Mackel et al.

(10) Patent No.: US 6,530,871 B1
(45) Date of Patent: Mar. 11, 2003

(54) CENTRIFUGE HAVING A BAG ARRANGEMENT AND A METHOD FOR OPERATING THE CENTRIFUGE

(75) Inventors: Wilfried Mackel, Oelde (DE); Werner Kohlstette, Oelde (DE); Thomas Kleimann, Oelde (DE); Willi Niemerg, Oelde (DE)

(73) Assignee: Westfalia Separator AG, Bielefeld (DE)

( * ) Notice: Subject to any disclaimer, the term of this patent is extended or adjusted under 35 U.S.C. 154(b) by 0 days.

(21) Appl. No.: 09/806,862

(22) PCT Filed: Sep. 29, 1999

(86) PCT No.: PCT/EP99/07211

§ 371 (c)(1),
(2), (4) Date: Apr. 5, 2001

(87) PCT Pub. No.: WO00/21679

PCT Pub. Date: Apr. 20, 2000

(30) Foreign Application Priority Data

Oct. 9, 1998 (DE) ..... 198 46 535

(51) Int. Cl.[7] ..... B04B 11/04

(52) U.S. Cl. ..... 494/37; 494/38; 494/56; 494/61

(58) Field of Search ..... 494/13, 14, 37–39, 494/43, 45, 56, 58, 59, 60, 61, 62; 210/360.1, 380.1

(56) References Cited

U.S. PATENT DOCUMENTS 2,179,807 A * 11/1939 Asmussen
4,397,637 A * 8/1983 Place
5,916,082 A * 6/1999 Opfer

FOREIGN PATENT DOCUMENTS

DE 8533545 U * 1/1986
DE 3542134 * 6/1987
WO 97/30715 * 8/1997

OTHER PUBLICATIONS

Hanno–R. Lehmann, Karl–Heinz Zettier, *Whey Processing Lines*, Technical–scientific documentation No. 6, Third revised edition 1988, Published by Westfalia Separator AG.

* cited by examiner

*Primary Examiner*—Charles E. Cooley
(74) *Attorney, Agent, or Firm*—Barnes & Thornburg

(57) ABSTRACT

A centrifuge, comprising: a centrifuge basket for separating a fed substance to be centrifuged into different constituents; a receptacle surrounding a portion of the basket; a bag insertable into the receptacle, the bag having an exterior wall and an interior for catching at least a portion of the constituents delivered by the centrifuge basket; a space surrounding the bag; and wherein the interior of the bag near an axis of rotation of the centrifuge basket is connected by a hose with the space surrounding the bag. A method of operating the centrifuge including the steps of mounting the receptacle, feeding the substance to be centrifuged, rotating the centrifuge basket and catching solids in the bag while separating the solids and liquid.

12 Claims, 2 Drawing Sheets

CENTRIFUGE HAVING A BAG ARRANGEMENT AND A METHOD FOR OPERATING THE CENTRIFUGE

The present invention relates to a centrifuge and to a method of operating the centrifuge.

U.S. Pat. No. 5,328,441 shows a centrifuge during whose operation, after the solids are centrifuged from the centrifuged material, the liquid is first drained from the centrifuge basket and subsequently the solids a peeled out of the centrifuge basket by means of a device specifically designed for this purpose. The solids are collected in a manner which is not visible below the centrifuge basket.

If a centrifuge of the above-mentioned type is used in the pharmaceutical field, for example, for obtaining solids from human blood and/or for producing insulin, the problem arises of handling the solids delivered by the centrifuge basket in a manner which is as hygienic and as sterile as possible. Although it is possible to remove the solids "manually" from the centrifuge or from a receptacle arranged below the centrifuge, such a handling appears problematic in view of the currently constantly increasing hygiene requirements. Furthermore, there is the problem that, when the discharge of solids is handled manually, losses must be expected which reduces the yield of solids. Specifically when obtaining solids from blood, the interest in obtaining solids from blood with as few losses as possible is particularly high.

German Patent Document DE-U-85 33 545.2 shows a centrifuge of the above-mentioned type. In this centrifuge, solid particles are caught in a bag. German Patent Document DE 35-42 134 A1 also shows a centrifuge of this type.

It is therefore an object of the invention to provide a centrifuge as well as a method of operating the centrifuge by means of which a largely loss-free obtaining of solids from a centrifuged substance such as blood can be implemented while the hygienic standard is raised.

The invention includes a receptacle for catching a portion of the constituents delivered by the centrifuge, particularly the solids. A bag is inserted into the receptacle for receiving the solids from the centrifuge basket. As a result of the catching of the solids in the bag inserted in the receptacle, a largely sterile handling of the solids is permitted because, after the filling or centrifuging operation, the bag, together with its content, must only be removed from the receptacle. Losses of solids when emptying the receptacle are avoided.

A hose connects the interior of the bag with the space surrounding the bag. The hose preferably leads into the interior of the bag in the proximity of the axis of rotation of the centrifuge basket. In the space below the centrifuge basket, because of the friction surfaces of the basket, the air, which surrounds the basket, will also rotate. As a result of the centrifugal forces, this rotation generates a pressure rise from the inside (axis of rotation) to the outside. Since, in addition, the space in the interior area—thus in the area of the axis of rotation—is connected to the ambient pressure, an excess pressure occurs in the outer area of the interior of the bag. As a result, the bag is "spread out" and pressed against the walls surrounding it, so that a particularly uncomplicated filling of the bag is ensured.

The hose preferably leads from the interior of the bag into the space between the bag exterior and the inside wall of the receptacle. When the pressure in the receptacle is lowered during the centrifuging, the pressure gradient generated by the rotation of the basket spreads out the bag. Furthermore, the low pressure facilitates the sterile handling of the centrifuged material.

In another particularly preferred embodiment of the invention, the hose includes a shut-off valve. The valve is closed in order to avoid contact of the solids with the ambient air when pressure in the receptacle increases after a centrifuging operation.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
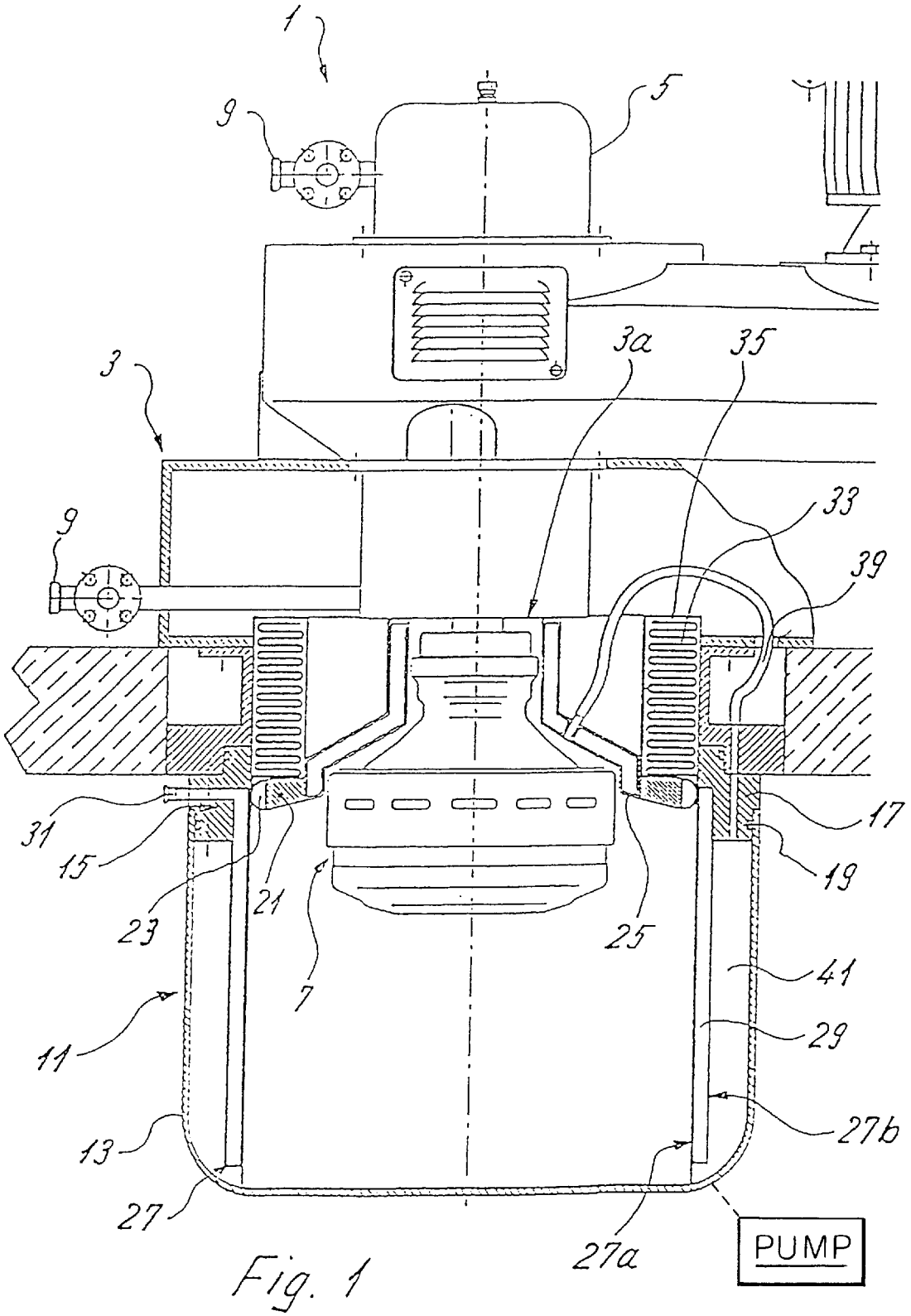
FIG. 1 is a schematic, partially sectional view of a centrifuge according to the invention.

FIG. 1 illustrates a centrifuge 1 with a housing 3 on which the drive unit 5 of a centrifuge basket 7 is arranged. Lines 9 permit the feeding and removal of a substance, such as blood, to be centrifuged in the centrifuge basket 7. This substance is to be separated in this centrifuge basket 7 into the liquid and the solid constituents.

The centrifuge basket 7 projects into a receptacle 11 on the underside of the housing 3. The centrifuge basket 7 has a cylindrical receptacle section 13 which is closed off downward in a cup-type manner and which can be mounted in a pressure-sealed manner on an upper receptacle end 15. The receptacle end 15 has a stepped ring 17 against whose outer wall the interior wall of the opening range of the cup-type receptacle section 13 rests in the closed condition of the receptacle 11. A sealing ring 19 is arranged between the stepped ring 17 and the lower receptacle section 13. The receptacle end 15 is completed by a sealing ring 21 situated on the inside of the ring 17; the sealing ring 21 has a sealing chamber 23 which can be inflated. When inflated, the sealing chamber 23 is pushed against the interior wall of the stepped ring 17. An insertion ring 25 for the separator basket 7 rests against the interior wall of the sealing ring 21, and comprises a lower cylindrical section 25*a*. A conically tapering section 25*b* adjoins in the upward direction, and an upper cylindrical section 25*c*, which at the top rests against the lower wall 3*a* of the housing 3 which covers the receptacle 11 toward the top. Through a tube line 26 extending through the lower wall of the housing 3*a*, the centrifuged material is provided to the separator basket.

The space enclosed by the lower and upper receptacle sections 13, 15 can be evacuated by a pump (see FIG. 1) so that the actual centrifuging operation can take place in a vacuum.

A cylindrical jacket 27 extends close to the bottom of the receptacle section 13 and rests on the lower portion of the interior wall of the stepped ring 15. The jacket 27 extends essentially parallel to the outer wall of the receptacle section 13 and is constructed with a double wall 27*a*, 27*b*. A space 29 is formed between the walls 27*a* and 27*b* to allow rinsing liquid to flow. The rinsing fluid can be fed by a feed line 31 and can be discharged by a discharge line (which is not shown here).

A foil-type material 33 is situated between the sealing chamber 23 and the interior wall of the stepped ring 17 as well as the interior wall of the jacket 27 adjoining in the downward direction. The material 33 is above the sealing ring 21 and is disposed in a ring-type receiving space 35 and form there can be pulled downward into the receptacle section 13.

Figure 2:
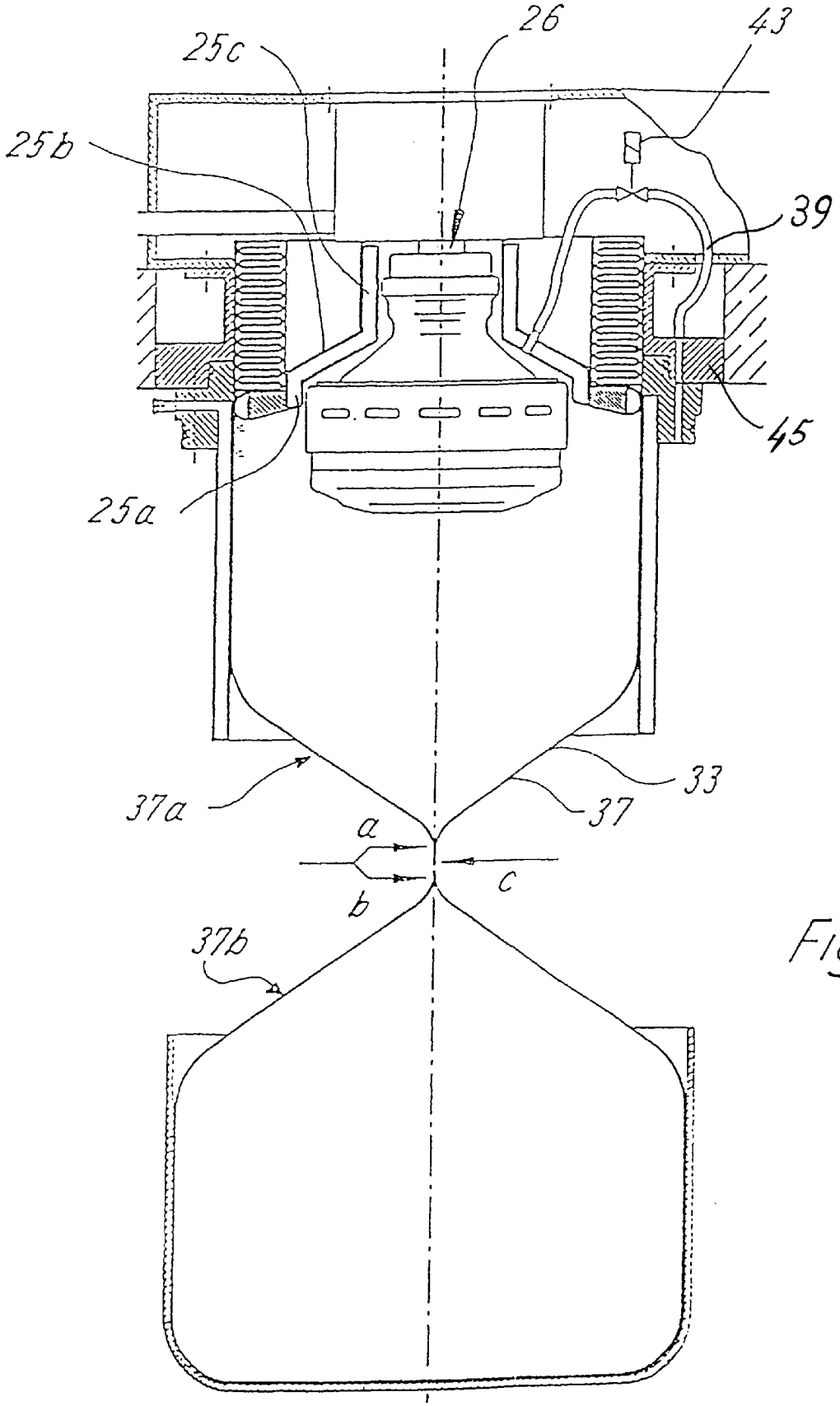
FIG. 2 is a partially sectional view of another centrifuge according to the invention in an operating position modified with respect to FIG. 1, during the welding-together of a bag filled with solids.

Before the start of a centrifuging operation, the lower receptacle section 13 is first lowered by means of a lifting device (not shown) suitable for this purpose (see FIG. 2). The material 33 is pulled downward from the receiving space 35 and is pressed together below the jacket 27 and above the receptacle section 13, and is welded together, for example, in two areas situated closely side-by-side (arrows a and b). This step forms a lower closure for an upper plastic bag 37*a* and an upper closure for a lower bag 37*b*. The two bags 37*a* and 37*b* are now separated from one another in the area of the arrow c. After the lower bag 37 was removed from the lower receptacle section 13, the lower receptacle section is lifted and guided in a pressure-tight manner over the ring 17.

After reducing the pressure in the receptacle 11, the centrifuging operation is started. As this occurs, the centrifuge basket projecting into the upper bag opening provides a pressure gradient in the interior of the bag. The interior of the bag 37*a* is connected by a hose 39 with the space 41 between the exterior wall of the bag and the interior wall of the receptacle 11. During rotations of the basket, the bag is pushed against the walls surrounding it and the solids therefore reach the interior of the bag completely without any problem. Damage to the bag is safely avoided. After the liquid is drained off and the basket is evacuated or when the bag is sufficiently filled with solids, the pressure in the receptacle is raised and the lower receptacle section is lowered, whereupon the bag walls are welded together and cut, after which a new centrifuging cycle can be started. The bag 37 allows separation of the solids in a sterile manner and with a very high yield.

As illustrated in FIGS. 1 and 2, the hose 39 can be provided with a shut-off valve 43 in order to close off the solids in the bag 37 with respect to the ambient air. According to FIG. 2, the hose 39 extends from the interior wall of the conical section 25*b* of the insertion ring 25 through the housing 3; then through a ring 45 situated below the housing 3 as well as through the ring 17 reaching into the ring 19 to the space 41.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A centrifuge, comprising:

a centrifuge basket for separating a fed substance to be centrifuged into different constituents;

a receptacle surrounding a portion of the basket;

a bag insertable into the receptacle, the bag having an exterior wall and an interior for catching at least a portion of the constituents delivered by the centrifuge basket;

a space surrounding the bag; and wherein the interior of the bag near an axis of rotation of the centrifuge basket is connected by a hose with the space surrounding the bag.

2. The centrifuge according to claim 1, wherein the hose extends from the interior of the bag to the space between the exterior wall of the bag and an interior wall of the receptacle.

3. The centrifuge according to claim 1, further comprising a shut-off valve for the hose.

4. The centrifuge according to claim 1, wherein the receptacle includes a lower receptacle section mountable in a pressure-tight manner on an upper receptacle closure, and the centrifuge basket extends from the upper receptacle closure to the interior of the receptacle and into an upper opening of the bag.

5. The centrifuge according to claim 1, wherein the receptacle includes a ring-type jacket extending essentially parallel to its exterior wall.

6. The centrifuge according to claim 5, wherein the jacket has a double wall through which cooling liquid can flow.

7. The centrifuge according to claim 1, further comprising a ring-shaped receiving space adjacent a top of the receptacle for receiving a material from which the bag is formed.

8. The centrifuge according to claim 7, wherein the receptacle includes a ring-type jacket essentially parallel to its exterior wall, and the centrifuge further includes a sealing ring with an inflatable sealing chamber for pressing the material against an interior wall of the jacket.

9. The centrifuge according to claim 7, wherein the bag is pulled downward into the receptacle and its open ends closed.

10. The centrifuge according to claim 9, further comprising a closing device for closing the material in two areas situated side-by-side.

11. The centrifuge according to claim 1, further comprising a pump for generating a vacuum in the receptacle.

12. A method of operating a centrifuge for separating a fed substance into different constituents of solids and liquid, the centrifuge having a centrifuge basket, a receptacle and a bag, the method comprising the steps of:

mounting the receptacle to surround a portion of the basket and the bag with an interior of the bag near an axis of rotation of the basket connected by a hose with a space surrounding the bag;

feeding the substance to be centrifuged into the centrifuge basket;

rotating the centrifuge basket about the axis of rotation to create a pressure gradient which spreads the bag outwardly from the axis; and catching the solids in the bag while separating the solids and liquid.

* * * * *